US011125006B2

(12) United States Patent
Chen et al.

(10) Patent No.: US 11,125,006 B2
(45) Date of Patent: Sep. 21, 2021

(54) METHOD, SYSTEM AND DEVICE FOR CONTROLLING DOOR OF RAILWAY VEHICLE

(71) Applicant: CRRC Qingdao Sifang Co., Ltd., Shandong (CN)

(72) Inventors: Bo Chen, Qingdao (CN); Jinghai Jiao, Qingdao (CN); Qing Tian, Qingdao (CN); Huiqing Zhang, Qingdao (CN); Qingjun Han, Qingdao (CN); Fangdong Hou, Qingdao (CN); Donghua Wu, Qingdao (CN); Lijun Ma, Qingdao (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 499 days.

(21) Appl. No.: 16/082,910

(22) PCT Filed: Dec. 8, 2016

(86) PCT No.: PCT/CN2016/109075
§ 371 (c)(1),
(2) Date: Sep. 6, 2018

(87) PCT Pub. No.: WO2017/152675
PCT Pub. Date: Sep. 14, 2017

(65) Prior Publication Data

US 2019/0024436 A1 Jan. 24, 2019

(30) Foreign Application Priority Data

Mar. 10, 2016 (CN) ..... 201610136825.5

(51) Int. Cl.
*E05F 15/73* (2015.01)
*E05F 15/70* (2015.01)
(Continued)

(52) U.S. Cl.
CPC ..... *E05F 15/73* (2015.01); *B61B 1/02* (2013.01); *E05F 15/70* (2015.01); *E05F 15/79* (2015.01);
(Continued)

(58) Field of Classification Search
CPC ..... B61L 27/04; B61D 19/026; B61D 19/02; E05F 15/73; E05F 15/70; E05F 15/79;
(Continued)

(56) References Cited

U.S. PATENT DOCUMENTS 5,119,739 A * 6/1992 Templeton ..... B61D 19/026 105/341
5,947,423 A * 9/1999 Clifton ..... B61L 3/225 246/62
(Continued)

FOREIGN PATENT DOCUMENTS

CN 101244724 A * 8/2008
CN 101244724 A 8/2008
(Continued)

OTHER PUBLICATIONS

International Search Report from International Application No. PCT/CN2016/109075, dated Feb. 28, 2017, 8 pages.
(Continued)

*Primary Examiner* — Scott A Browne
(74) *Attorney, Agent, or Firm* — Cantor Colburn LLP

(57) ABSTRACT

A method, system and device for controlling a door of a railway vehicle are provided. The method comprises: a door control instruction sent by a transponder is received when a railway vehicle draws into the station, wherein the door control instruction is used for determining a door of the railway vehicle at a platform side; and the railway vehicle is controlled to open the door of the railway vehicle at the platform side according to the door control instruction,
(Continued)

thereby solving the technical problem that the door of a railway vehicle at the non-platform side may be opened by mistake by a driver due to human factors because the door of the railway vehicle at the platform side is manually opened when the railway vehicle stops.

10 Claims, 2 Drawing Sheets

(51) Int. Cl.
*E05F 15/79* (2015.01)
*B61B 1/02* (2006.01)
*E05F 17/00* (2006.01)

(52) U.S. Cl.
CPC ..... *E05F 17/00* (2013.01); *E05F 2017/005* (2013.01); *E05Y 2900/51* (2013.01); *E05Y 2900/531* (2013.01)

(58) Field of Classification Search
CPC ..... E05F 17/00; B61B 1/02; E05Y 2900/51; E05Y 2900/531
See application file for complete search history.

(56) References Cited

U.S. PATENT DOCUMENTS

2011/0029166 A1* 2/2011 Iga ..... B61L 15/0036 701/19
2015/0059247 A1* 3/2015 Inatama ..... E05F 15/40 49/13
2015/0246679 A1* 9/2015 Radczimanowski ..... B61B 1/02 104/28

FOREIGN PATENT DOCUMENTS

| | | | | |
|---|---|---|---|---|
| CN | 102007032 | A | 4/2011 | |
| CN | 102267481 | A | 12/2011 | |
| CN | 103630381 | A | 3/2014 | |
| CN | 104832026 | A | 8/2015 | |
| CN | 105781318 | A | 7/2016 | |
| EP | 1759954 | A1 | 3/2007 | |
| EP | 2708432 | A1 | 3/2014 | |
| EP | 2746132 | A1 | 6/2014 | |
| JP | 5032608 | | 3/1975 | |
| JP | 2002205640 | A | 7/2002 | |
| WO | 9400953 | A1 | 1/1994 | |
| WO | WO-2012155840 | A1 * | 11/2012 | ..... B61L 27/0038 |

OTHER PUBLICATIONS

International Written Opinion from International Application No. PCT/CN2016/109075, dated Feb. 28, 2017, 4 pages.
Chinese Search Report for Chinese Application No. 201610136825.5, dated Dec. 21, 2016, 2 pages.
Chinese First Office Action for Chinese Application No. 201610136825.5, dated Dec. 30, 2016, 15 pages with English Translation.
European Search Report for corresponding application EP16893318; dated Apr. 30, 2019.

* cited by examiner

METHOD, SYSTEM AND DEVICE FOR CONTROLLING DOOR OF RAILWAY VEHICLE

CROSS-REFERENCE TO RELATED APPLICATIONS

This application is a national phase entry under 35 U.S.C. § 371 of International Patent Application PCT/CN2016/109075, filed Dec. 8, 2016, designating the United States of America and published as International Patent Publication WO 2017/152675 A1 on Sep. 14, 2017, which claims the benefit under Article 8 of the Patent Cooperation Treaty to Chinese Patent Application Serial No. 201610136825.5, filed Mar. 10, 2016, the disclosure of each of which is hereby incorporated herein in its entirety by this reference.

TECHNICAL FIELD

The present disclosure relates to the field of vehicle control and, in particular, to a method, system and device for controlling a door of a railway vehicle.

BACKGROUND

At present, in a related art, after a railway vehicle draws into the station, the door at the platform side of the railway vehicle should be opened. However, owing to difference in driving direction of the vehicle, whether the door at the platform side is the left door or right door of the vehicle is merely determined by the driver of the vehicle through observation. When the driver opens an incorrect door due to fatigue or other human factors, the passengers may fall off the platform to cause an accident.

The door of the railway vehicle at the non-platform side may be opened by mistake by a driver due to human factors, because the door of the railway vehicle at the platform side is manually opened when the railway vehicle stops. Regarding this problem in the related art, no effective solution has yet been provided.

BRIEF SUMMARY

The embodiments in the present disclosure provide a method, system and device for controlling a door of a railway vehicle to at least solve the technical problem that doors of the railway vehicle at the non-platform side may be opened by mistake by a driver due to human factors because the door of the railway vehicle at the platform side is manually opened when the railway vehicle stops.

According to one aspect of the embodiments in the present disclosure, a method for controlling a door of a railway vehicle is provided, comprising: receiving a door control instruction sent by a transponder when the railway vehicle draws into the station, wherein the door control instruction is used for determining a door of the railway vehicle at a platform side; and controlling the railway vehicle to open the door of the railway vehicle at the platform side according to the door control instruction.

According to another aspect of the embodiments in the present disclosure, a system for controlling a door of a railway vehicle is further provided, comprising: a transponder mounted at an entrance and exit of the railway station, configured to send a door control instruction, wherein the door control instruction is for determining a door of the railway vehicle at a platform side; an information receiver mounted at a bottom of the railway vehicle, at least comprising a receiving antenna, configured to receive the door control instruction sent by the transponder; a computer connected with the information receiver, configured to receive the door control instruction and send the door control instruction to a door controller; a door controller connected to the computer, configured to obtain the door control instruction received by the computer and control the door of the railway vehicle at the platform side to be opened according to the door control instruction.

According to another aspect of the embodiments in the present disclosure, a device for controlling a door of a railway vehicle is provided, comprising: a receiving component, configured to receive a door control instruction sent by a transponder when a railway vehicle draws into a station, wherein the door control instruction is used for determining a door of the railway vehicle at a platform side; and a first controlling component, configured to control the railway vehicle to open the door of the railway vehicle at the platform side according to the door control instruction.

In the embodiments of the present disclosure, a door control instruction sent by a transponder is received when a railway vehicle draws into the station, wherein the door control instruction is for determining a door of the railway vehicle at a platform side; and the railway vehicle is controlled to open the door of the railway vehicle at the platform side according to the door control instruction. According to the above manner, the aim of non-manually determining the door of the vehicle at the platform side is achieved by sending a door controller instruction, thereby achieves the technical effect of avoiding the circumstance that a door of the vehicle at the non-platform side are opened by mistake due to human factors, thus solving the technical problem that the door of the railway vehicle at the non-platform side may be opened by mistake by a driver due to human factors because the door of the railway vehicle at the platform side is manually opened when the railway vehicle stops.

BRIEF DESCRIPTION OF THE DRAWINGS

For a better understanding of the present disclosure, accompanying drawings described hereinafter are provided to constitute one part of the application; the schematic embodiments of the present disclosure and the description thereof are used to illustrate the present disclosure but not to limit the present disclosure improperly. In the accompanying drawings.

DETAILED DESCRIPTION

Figure 1:
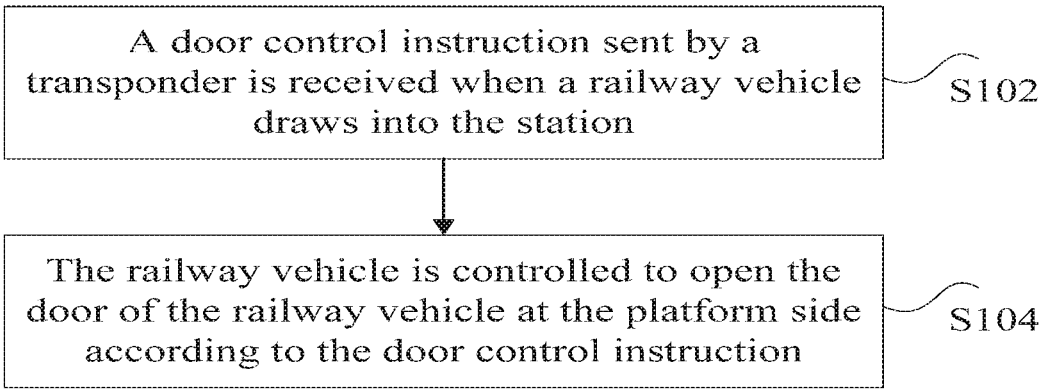
FIG. 1 is a flowchart of a method for controlling a door of a railway vehicle according to an embodiment of the present disclosure.

In order to make those skilled in the art better understand the solutions of the present application, the technical solutions in the embodiments of the present application will be clearly and completely described below in conjunction with the drawings in the embodiments of the present application. Obviously, the described embodiments are only a part of the embodiments of the present application, not all of the embodiments. On the basis of the embodiments of the present application, all other embodiments obtained on the premise of no creative work of those skilled in the art shall fall within the scope of protection of the present application.

It is important to note that the description and claims of the present application and terms "first," "second" and the like in the drawings are used to distinguish similar objects, and do not need to describe a specific sequence or a precedence order. It will be appreciated that data used in such a way may be exchanged under appropriate conditions, in order that the embodiments of the present application described here can be implemented in a sequence except sequences graphically shown or described here. In addition, terms "include" and "have" and any inflexions thereof are intended to cover non-exclusive inclusions. For example, processes, methods, systems, products or equipment containing a series of steps or units do not need to clearly show those steps or units, and may include other inherent steps or units of these processes, methods, products or equipment, which are not clearly shown instead.

Example 1

According to an embodiment of the present disclosure, an embodiment of a method for controlling a door of a railway vehicle is provided. It should be noted that the steps illustrated in the flowcharts of the accompanying drawings may be implemented in a computer system comprising a group of computer executable instructions. Moreover, although a logic order is illustrated in the flowchart, the steps illustrated or described may be implemented in an order different from the order here under some circumstances.

FIG. 1 is a flowchart of a method for controlling a door of a railway vehicle according to an embodiment of the present disclosure. As shown in FIG. 1, the method comprises the following steps:

Step S102: a door control instruction sent by a transponder is received when the railway vehicle draws into the station, wherein the door control instruction is used for determining a door of the railway vehicle at a platform side.

In an optional embodiment, the transponder may be mounted at the entrance and exit of the railway station. When drawing into the station to a stop, the railway vehicle will pass by the transponder. After receiving the electromagnetic energy sent by the antenna mounted at the bottom of the railway vehicle, the transponder converts the energy received to working power supply, starts the internal circuit to work, and sends the transmission message pre-stored inside the transponder to a receiving antenna, wherein the transmission message at least includes a door control instruction.

It should be noted here that the transmission message at least includes the above door control instruction, but is not limited to the door control instruction, and it may further include line slope, line allowable speed, link information, etc., i.e., a transponder may be used for determining the door of the railway vehicle at the platform side, but functions of a transponder are not limited to the above.

Figure 2:
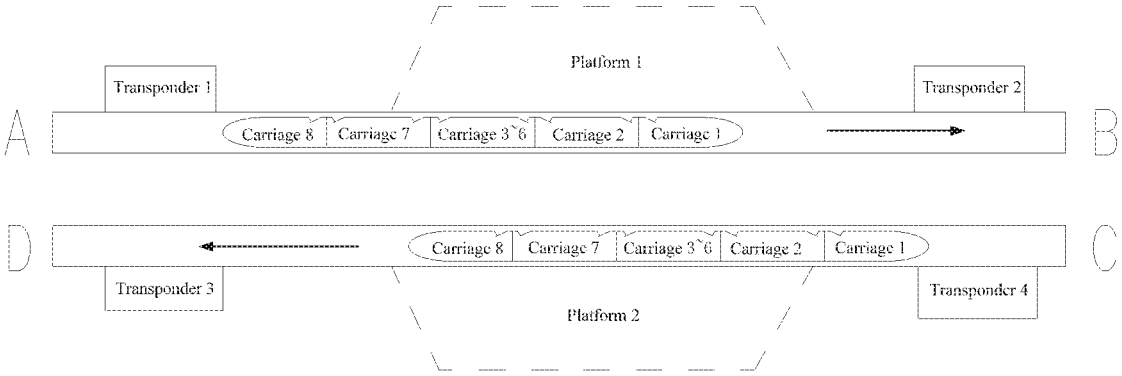
FIG. 2 is a schematic diagram of positions of station track and platform of a railway vehicle according to the related art.

In another optional embodiment, the door of the vehicle at the platform side is determined according to the station type. FIG. 2 is a schematic diagram of positions of station track and platform of a railway vehicle according to the related art. As shown in FIG. 2, the railway vehicle comprises eight numbered carriages represented by carriage 1 to carriage 8; AB is a track for the railway vehicle to travel in a direction from A to B, and CD is a track for the railway vehicle to travel in a direction from C to D, i.e., AB and CD are two parallel tracks in opposite directions. When the vehicle traveling in the direction from A to B draws into the station and stops (as shown by the arrow in the track AB of the drawing), the door near the first platform, i.e., the left door of the railway vehicle should be opened. When the railway vehicle traveling in the direction from C to D draws into the station (as shown by the arrow in the track CD of the drawing), the door near the second platform, i.e., the right door of the railway vehicle should be opened, and the transponder at the entrance and the exit records the position information of the door of the vehicle at the platform side in advance according to the above station type. It should be noted here that the above left door and right door take carriage 1 as a front reference. When the railway vehicle changes the traveling direction, a leading carriage of the vehicle is taken as the vehicle head until changing the traveling direction of the railway vehicle by turning around. The vehicle tail in the initial direction will be the vehicle head of the new traveling direction, so as to achieve changing the traveling direction of the railway vehicle, i.e., when the railway vehicle travels from A to B, carriage 1 is the vehicle head; when the railway vehicle travels from C to D, carriage 8 is the vehicle head.

Step S104: the railway vehicle is controlled to open the door of the railway vehicle at the platform side according to the door control instruction.

In the step above, the door control instruction provides information of the door of the vehicle at the platform side for the railway vehicle. Therefore, when the door of the railway vehicle is opened according to the information provided by the door control instruction, the circumstance that incorrect doors are opened can be avoided.

In an optional embodiment, the receiving antenna sends the information corresponding to the door control instruction to the security computer of the vehicle after receiving the door control instruction sent by the transponder. The security computer of the vehicle may be equipped with a display device for displaying man-machine interface. The human-machine interface may convert the door control instruction information into image, text or voice information to prompt the vehicle driver which door should be opened. The vehicle driver makes corresponding operations according to the prompt of the security computer to open the door of the vehicle at the platform side.

In another optional embodiment, after the receiving antenna sends the door control instruction sent by the transponder to the security computer of the vehicle, the security computer directly controls the vehicle to open the door of the railway vehicle at the platform side according to the door control instruction.

In the embodiments of the present disclosure, a door control instruction sent by a transponder is received when a railway vehicle draws into the station, wherein the door control instruction is for determining a door of the railway vehicle at a platform side; the railway vehicle is controlled to open the door of the railway vehicle at the platform side according to the door control instruction. According to the above manner, the aim of non-manually determining the door of the vehicle at the platform side is achieved by sending a door controller instruction, thereby the technical effect of avoiding the circumstance that the door of the vehicle at the non-platform side is opened by mistake due to human factors is achieved, thus solving the technical problem that the door of the railway vehicle at the non-platform side may be opened by mistake by a driver due to human factors because the door of the railway vehicle at the platform side is manually opened when the railway vehicle stops.

In the above embodiment of the present application, in step S102, before the railway vehicle is controlled to open the door of the railway vehicle at the platform side according to the door control instruction, the method further comprises:

Step S106: the door control mode of the railway vehicle is selected, wherein the door control mode includes a manual door control mode and an automatic door control mode.

In the above step, the manual door-opening mode may be that the door of the vehicle is not opened until the driver of the vehicle makes a door-opening action for the vehicle. When the vehicle is in the manual mode, the driver determines the door of the vehicle at the platform side through the prompt of the security computer, and is unnecessary to determine the door of the vehicle at the platform side through observation; therefore, the circumstance that the incorrect door is opened due to human factors or other factors can be avoided.

The automatic door control mode may be that after the safety computer of the vehicle receives the door control instruction sent by the transponder, the vehicle is automatically controlled to open the door of the corresponding side, and the driver does not need to manually operate.

In an optional embodiment, the user selects the door control mode of the vehicle through an automatic/manual selector switch on the switchboard in the driver's cab.

In the above embodiment of the present application, in step S104, when the railway vehicle is in the manual door control mode, controlling the railway vehicle to open the door of the railway vehicle at the platform side according to the door control instruction comprises:

Step S1041: a lock signal is sent to the door controller corresponding to the door of the railway vehicle at the non-platform side according to the door control instruction.

In the above step, the display device may be a display device located in the driver's cab, and the display device is equipped with a human-machine interface. In an optional embodiment, the display device may be a touch screen display device, and may further receive the driver's operation after displaying preset display content. The lock signal is used to lock the door of the vehicle at the non-platform side, that is, even if the driver triggers the vehicle to open the door at the non-platform side, the door of the vehicle at the non-platform side will not be opened, because the door controller at the non-platform side receives a door-locking signal.

It should be noted here that the preset display content displayed on the display device may contain content corresponding to the door control instruction, but is not limited to this. In contrast to the display content in the vehicle driver's cab in the related art, the above display device needs to display the display content corresponding to the door control instruction, but will still display the preset display content in the related art.

Step S1043: a first door-opening control signal of the railway vehicle is monitored, wherein the first door-opening control signal comprises:

a correct first door-opening signal for controlling the door of the railway vehicle at the platform side to be opened, or an incorrect first door-opening signal for controlling the door of the railway vehicle at the non-platform side to be opened.

In the above step, the first door-opening control signal is obtained through operation of the driver, wherein the correct first door-opening control signal is for representing the signal generated by triggering opening of the switch lock of the door of the vehicle at the platform side after the driver receives the prompt of the door control instruction; the incorrect first door-opening control signal is for representing the signal generated by triggering opening of the switch lock of the door of the vehicle at the non-platform side after the driver receives the prompt of the door control instruction.

Step S1045: when the first door-opening control signal is a correct door-opening signal, the door of the railway vehicle at the platform side is opened.

Step S1047: when the first door-opening control signal is an incorrect door-opening signal, the door at the non-platform side is prohibited from being opened according to the lock signal.

As can be seen, the above step in the present application is for monitoring the first door-opening control signal of the railway vehicle. When the first door-opening control signal is a correct door-opening signal, the door of the railway vehicle at the platform side is opened; when the first door-opening control signal is an incorrect door-opening signal, the door at the non-platform side is prohibited from being opened according to the lock signal. The above solution prompts the driver through the door control instruction, and prohibits the door at the non-platform side from being opened when the driver operates incorrectly, which achieves the technical objective of preventing the door of the vehicle at the non-platform side from being opened, and when the first door-opening control signal is an incorrect door-opening signal, the door at the non-platform side is prohibited from being opened according to the lock signal, thus solving the problem in the related art.

In an optional embodiment, before a lock signal is sent to the door controller corresponding to the door of the railway vehicle at the non-platform side according to the door control instruction, the above method may also comprise: the preset display content corresponding to the door control instruction is displayed on the preset display device.

In the above embodiment of the present application, when the railway vehicle is in the automatic door control mode, the above method comprises:

Step S1061: a second door-opening control signal of the railway vehicle is monitored.

According to an example embodiment, in the above step, the second door-opening control signal is sent by a control system of the vehicle to automatically control the vehicle to open the door at the platform side.

Step S1063: the door of the railway vehicle at the platform side is automatically controlled to be opened when the second door-opening signal of the railway vehicle is obtained through monitoring.

As can be seen, in the above step of the present application, when the railway vehicle is in the automatic door control mode, the second door-opening control signal of the railway vehicle is monitored; when the second door-opening signal of the railway vehicle is obtained through monitoring, the door of the railway vehicle at the platform side is automatically controlled to be opened. Since the driver does not need to operate manually, this achieves the technical effect of automatic opening of door of the vehicle at the platform side, thereby solving the technical problem that when the first door-opening control signal is an incorrect door-opening signal, the door at the non-platform side is prohibited from being opened according to the lock signal.

In the above embodiment of the present application, in step S104, after opening of the door of the railway vehicle at the platform side is controlled, the method further comprises:

Step S1049: the door of the railway vehicle at the platform side is controlled to be closed when a first door-closing control signal is received.

In the above step, the door of the railway vehicle at the platform side is controlled to be closed when the first door-closing control signal is received, which realizes control of closing the door of the vehicle.

It should be noted here that when the vehicle is in the manual door control mode, the first door-closing control signal is issued to the vehicle by the driver manually.

In the above embodiment of the present application, in step S104, after the door of the railway vehicle at the platform side is controlled to be opened, the method further comprises:

Step S108: the door of the railway vehicle at the platform side is controlled to close when a second door-closing control signal is received, wherein the second door-closing control signal is issued after a preset duration of opening the door at the platform side.

In the above step, the second door-closing control signal is a door-closing signal when the vehicle is in the automatic door control mode. The second door-closing signal is issued automatically by the controller in the driver's cab to control the vehicle to close the door. The opened duration of the door of the vehicle is preset by a person on the controller in the driver's cab according to the flow rate of the visitors to each of the stations, and when the opened duration of the door of the vehicle reaches the preset duration, the controller will issue a signal of controlling the vehicle to close the door.

In the above embodiment of the present application, when the railway vehicle draws into the station, the railway vehicle shields a door control instruction by receiving a door control instruction shielding signal, such that door of the railway vehicle at any side can be opened according to any door-opening control signal of the railway vehicle.

In the above step, the door control instruction shielding signal is used for shielding the door control instruction issued by the transponder, such that the driver can open or close any door of the vehicle.

Example 2

According to another embodiment of the present disclosure, an embodiment of a system for controlling a door of a railway vehicle is provided. The method for controlling the door of the railway vehicle in Example 1 of the present disclosure may be implemented in the system for controlling a door of a railway vehicle in Example 2 of the present disclosure.

Figure 3:
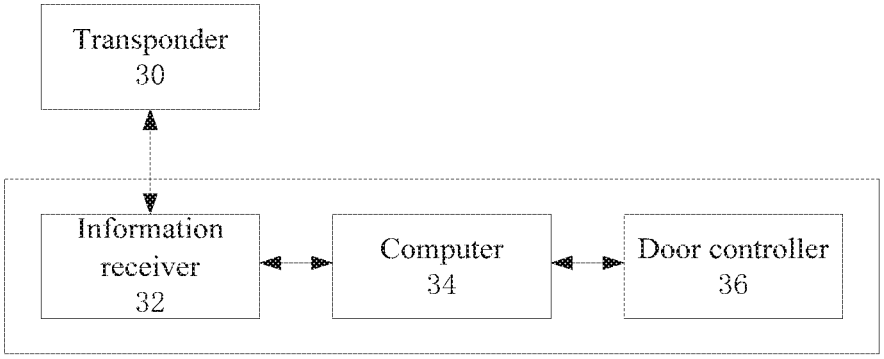
FIG. 3 is a structural diagram of an optional system for controlling a door of a railway vehicle according to Example 2 of the present disclosure.

FIG. 3 is a structural diagram of an optional system for controlling a door of a railway vehicle according to Example 2 of the present disclosure. As shown in FIG. 3, the system for controlling the door of the railway vehicle comprises a transponder 30, an information receiver 32, a computer 34, and a door controller 36.

Transponder 30 is mounted at an entrance and exit of the railway station for sending a door control instruction, wherein the door control instruction is used for determining a door of the railway vehicle at a platform side.

In an optional embodiment, the transponder may be mounted at the entrance and exit of the railway station. When drawing into the station to stop, the railway vehicle will pass by the transponder. After receiving the electromagnetic energy sent by the antenna mounted at the bottom of the railway vehicle, the transponder converts the energy received to working power supply, starts the internal circuit to work, and sends the transmission message pre-stored inside the transponder to a receiving antenna, wherein the transmission message at least includes a door control instruction.

In another optional embodiment, the door of the vehicle at the platform side is determined according to the station type. FIG. 2 is a schematic diagram illustrating positions of the station tracks and platforms in the related art. As shown in FIG. 2, AB and CD are two parallel tracks in opposite directions, when a vehicle traveling from A to B draws into the station and stops, the door near the first platform, i.e., the left door of the railway vehicle should be opened; when a railway vehicle traveling from C to D draws into the station, the door near the second platform, i.e., the right door of the railway vehicle should be opened, and the transponder at the entrance and the exit records the information of positions of the door of the vehicle at the platform side in advance according to the above station type.

Information receiver 32 is mounted at the bottom of the railway vehicle, at least comprising a receiving antenna, and configured to receive a door control instruction sent by the transponder.

Computer 34 is connected with the information receiver, configured to receive a door control instruction and sends the door control instruction to a door controller.

In an example embodiment, the computer may be a security computer located in the driver's cab of the vehicle.

In an optional embodiment, the information received by the information receiver is checked, and then input to the security computer to provide data for the security computer generating a braking mode curve; the security computer meantime sends the door control instruction to a main door controller for door control via a security relay signal, and presents a prompt for the driver's door-opening and door-closing operations on the display interface in the mode of picture, text and/or sound.

Door controller 36 is connected to a computer, configured to obtain a door control instruction received by the computer and control the door of the railway vehicle at the platform side to be opened according to the door control instruction.

In an optional embodiment, the door controller comprises a main door controller and a plurality of a door controller located above each of doors of the carriages, wherein the main door controller may be connected with other door controllers in the carriages via RS485 control wires, and the main door controller accesses the vehicle network via an MVB bus to implement data transmission, thereby implementing door control.

In the above embodiment of the present disclosure, a transponder mounted at an entrance and exit of the station sends a door control instruction, wherein the door control instruction is for determining a door of the railway vehicle at a platform side; an information receiver mounted at the bottom of the railway vehicle receives a door control instruction sent by the transponder; a computer connected with the information receiver receives a door control instruction and sends the door control instruction to a door controller; a door controller connected with the computer acquires a door control instruction received by the computer and controls the door of the railway vehicle at the platform side to be opened according to the door control instruction. By sending a door controller instruction, the above solution achieves the aim of determining the door of the vehicle at the platform side non-manually, achieves the technical effect of avoiding opening the door of the vehicle at the non-platform side by mistake due to human factors, thereby solving the technical problem that the door of the railway vehicle at the non-platform side is opened by mistake by a driver due to human factors because doors of the railway vehicle at the platform side is manually opened when the railway vehicle stops.

In the above embodiment of the present disclosure, the system further comprises: a display device connected with a computer, configured to display the preset display content corresponding to the door control instruction.

In the above system, the display device may be a display device located in the driver's cab, and the display device is equipped with a human-machine interface. In an optional embodiment, the display device may be a touch screen display device, and may also receive the driver's operation after displaying preset display content. A lock signal is used to lock the door of the vehicle at the non-platform side, that is, even if the driver triggers the vehicle to open the door at the non-platform side, the door of the vehicle at the non-platform side will not be opened, because the door controller at the non-platform side receives a door-locking signal.

It should be noted here that the preset display content displayed on the display device may contain contents corresponding to the door control instruction, but are not limited to this. In contrast to the display content in the vehicle driver's cab in the related art, the above display device may display the content corresponding to the door control instruction, but will still display the preset display content in the related art.

In the above embodiment of the present application, the system further comprises: a selection switch, configured to select a door control mode of the railway vehicle, wherein the door control mode includes a manual door control mode and an automatic door control mode.

For the system, the manual door-opening mode may be that the corresponding door of the vehicle is opened when the driver of the vehicle makes a door-opening action for the vehicle; when the vehicle is in the manual mode, the driver determines the door of the vehicle at the platform side through the prompt of the security computer, and does not need to determine the door of the vehicle at the platform side through observation; therefore, the circumstance that an incorrect door is opened due to human factors can be avoided.

The automatic door control mode may be that after the safety computer of the vehicle receives the door control instruction sent by the transponder, it automatically controls the vehicle to open the door of the corresponding side, and the driver does not need to operate.

In an optional embodiment, the user may select the door control mode of the vehicle through an automatic/manual selector switch on the switchboard in the driver's cab.

In the above embodiment of the present application, when the railway vehicle is in the manual door control mode, when the first door-opening control signal received by the door controller is a correct first door-opening control signal controlling the railway vehicle to open the door at the platform side, the door at the platform side is controlled to be opened; when the first door-opening control signal received by the controller is an incorrect first door-opening control signal controlling the railway vehicle to open the door at the non-platform side, the lock signal received simultaneously prohibits the door at the non-platform side from being opened. When the railway vehicle is in the automatic door control mode, and when the door controller receives a second door-opening control signal, the door at the platform side is controlled automatically to be opened.

In the above system, the first door-opening control signal is obtained through operation of the driver, wherein the correct first door-opening control signal is for representing the signal generated by triggering opening of the switch lock of the door of the vehicle at the platform side after the driver receives the prompt of the door control instruction; the incorrect first door-opening control signal is for representing the signal generated by triggering opening of the switch lock of the door of the vehicle at the non-platform side after the driver receives the prompt of the door control instruction.

As can be seen, the above system in the present disclosure is used for monitoring the first door-opening control signal of the railway vehicle. When the first door-opening control signal is a correct door-opening signal, the door of the railway vehicle at the platform side is opened; when the first door-opening control signal is an incorrect door-opening signal, the door at the non-platform side is prohibited from being opened according to the lock signal. The above solution prompts the driver through the door control instruction, and prohibits the door at the non-platform side from being opened when the driver operates incorrectly, which achieves the technical objective of preventing the door of the vehicle at the non-platform side from being opened, and when the first door-opening control signal is an incorrect door-opening signal, the door at the non-platform side is prohibited from being opened according to the lock signal, thus solving the technical problem in the related art.

In the above embodiment of the present disclosure, the door controller is further for controlling the railway vehicle to close the door by receiving a door-closing signal.

It should be noted here that when the vehicle is in the manual door control mode, the door controller controls the railway vehicle to close the door through the first door-closing control signal issued manually by the driver.

It should be further noted here that when the vehicle is in the automatic door control mode, the door controller controls the railway vehicle to close the door through a second door-closing control signal issued automatically by the controller in the driver's cab, the opened duration of the door of the vehicle is preset by a person on the controller in the driver's cab according to the flow rate of the visitors to each of the stations, and when the door-opening duration of the vehicle reaches the preset duration, the controller will issue a signal of controlling the vehicle to close the door.

In the above embodiment of the present disclosure, the system further comprises:

The door controller is further used for shielding a door control instruction by receiving a door control instruction shielding signal, such that door of the railway vehicle can be opened according to any door-opening control signal of the railway vehicle.

In the above embodiment of the present application, the system further comprises:

an indicator light connected with the door controller, which is lit when the railway vehicle opens or closes the door;

a buzzer connected with the door controller, which buzzes when the railway vehicle opens or closes the door.

As can be seen, by means of the system provided in the above embodiment, the present application achieves the aim that when the door of the vehicle is closed, the passengers are prompted by the indicator light and the buzzer, so as to prevent an accident that a passenger is clamped by the door caused by sudden closing of the door when the passenger does not know the sudden closing.

Example 3

Figure 4:
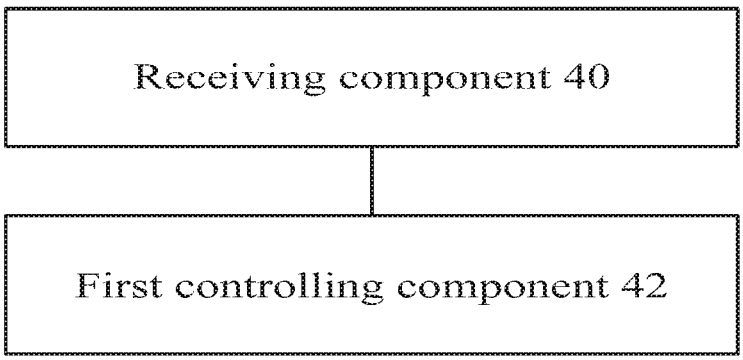
FIG. 4 is a schematic diagram of a device for controlling a door of a railway vehicle according to Example 3 of the present disclosure.

FIG. 4 is a schematic diagram of a device for controlling a door of a railway vehicle according to Example 3 of the present disclosure. For the purpose of description, the illustrated system structure is merely an example of a suitable environment, and does not intend to set any limitation for the use, range or function of the present application. The door control device based on the railway vehicle should not either be considered as having any dependency or requirement for any component or combination illustrated in FIG. 4.

As shown in FIG. 4, the device for controlling the door of the railway vehicle may comprise a receiving component 40 and a first controlling component 42, wherein:

The receiving component 40 is configured to receive a door control instruction sent by the transponder when the railway vehicle draws into the station, wherein the door control instruction is used for determining the door of the railway vehicle at the platform side.

The first controlling component 42 is configured to control the railway vehicle to open the door of the railway vehicle at the platform side according to the door control instruction.

It should be noted here that the transmission message at least includes the door control instruction, but is not limited to the door control instruction, and the transmission message may further include line slope, line allowable speed, link information, etc., i.e., a transponder may be used for determining the door of a railway vehicle at the platform side, but functions of a transponder are not limited to this.

In an optional embodiment, the door of the vehicle at the platform side is determined according to the station type. FIG. 2 is a schematic diagram illustrating positions of the station tracks and platforms in the related art. As shown in FIG. 2, AB and CD are two parallel tracks in opposite directions, when a vehicle traveling from A to B draws into the station and stops, the door near the first platform, i.e., the left door of the railway vehicle should be opened; when a railway vehicle traveling from C to D draws into the station, the door near the second platform, i.e., the right door of the railway vehicle should be opened, and the transponder at the entrance and the exit records the information of positions of the doors of the vehicle at the platform side in advance according to the above station type.

It should be noted here that the receiving component 40 and the first controlling component 42 may operate in a computer terminal as a part of the device, and functions realized by the above components can be implemented through a processor in the computer terminal. The computer terminal also may be a terminal device such as a smart phone (such as an Android phone and an iOS phone), a tablet PC, a palmtop computer, a mobile Internet device (MID), and a PAD.

In the embodiment of the present disclosure, a receiving component 40 is provided to receive the door control instruction sent by the transponder when the railway vehicle draws into the station, wherein the door control instruction is used for determining the door of the railway vehicle at the platform side. A first controlling component 42 is provided to control the railway vehicle to open the door. According to the above manner of sending a door controller instruction, the aim of determining doors of the vehicle at the platform side non-manually is achieved, thus achieving the technical effect of avoiding opening the door of the vehicle at the non-platform side by mistake due to human factors, thereby solving the technical problem that the door of the railway vehicle at the non-platform side is opened when the driver operates incorrectly due to human factors caused by opening the door at the platform side manually when a railway vehicle stops in the related art.

In the above embodiment of the present disclosure, the device further comprises: a selecting component configured to select a door control mode of the railway vehicle, wherein the door control mode includes a manual door control mode and an automatic door control mode.

For the device, the manual door-opening mode may be that the corresponding door of the vehicle is opened when the driver of the vehicle makes a door-opening action for the vehicle; when the vehicle is in the manual mode, the driver determines the door of the vehicle at the platform side through the prompt of the security computer, and does not need to determine the door of the vehicle at the platform side through observation; therefore, the circumstance that the incorrect door is opened due to human factors can be avoided.

It should be noted here that the selecting component may operate in a computer terminal as a part of the device, and functions realized by the module may be implemented through a processor in the computer terminal. The computer terminal also may be a terminal device such as a smart phone (such as an Android phone and an iOS phone), a tablet PC, a palmtop computer, a mobile Internet device (MID), and a PAD.

In the above embodiment of the present disclosure, when the railway vehicle is in the manual door control mode, the first controlling component comprises: a displaying component configured to display the preset display content corresponding to the door control instruction on a preset display device and send a lock signal to the door controller corresponding to the door of the railway vehicle at the non-platform side;

a first monitoring component configured to monitor a first door-opening control signal of the railway vehicle, wherein the first door-opening control signal comprises: a correct first door-opening signal controlling the door of the railway vehicle at the platform side to be opened, or an incorrect first door-opening signal controlling the door of the railway vehicle at the non-platform side to be opened;

an opening component configured to open the door of the railway vehicle at the platform side when the first door-opening control signal is the correct door-opening signal. When the first door-opening control signal is the incorrect door-opening signal, the lock signal prohibits the door at the non-platform side from being opened.

For the device, the manual door-opening mode may be that the corresponding door of the vehicle is opened when the driver of the vehicle makes a door-opening action for the vehicle; when the vehicle is in the manual mode, the driver determines the door of the vehicle at the platform side through the prompt of the security computer, and does not need to determine the door of the vehicle at the platform side through observation; therefore, the circumstance that the incorrect door is opened due to human factors can be avoided.

It should be noted here that the displaying component, the first monitoring component, and the opening component may operate in a computer terminal as a part of the device, and functions realized by the above components may be implemented through a processor in the computer terminal. The computer terminal also may be a terminal device such as a smart phone (such as an Android phone and an iOS phone), a tablet PC, a palmtop computer, a mobile Internet device (MID), and a PAD.

In the above embodiment of the present disclosure, when the railway vehicle is in the automatic door control mode, the device comprises:

a second monitoring component configured to monitor a second door-opening control signal of the railway vehicle;

a second controlling component configured to automatically control opening the door of the railway vehicle at the platform side when the second door-opening signal of the railway vehicle is obtained through monitoring.

It should be noted here that the second monitoring component and the second controlling component may operate in a computer terminal as a part of the device, and functions realized by the above components may be implemented through a processor in the computer terminal. The computer terminal also may be a terminal device such as a smart phone (such as an Android phone and an iOS phone), a tablet PC, a palmtop computer, a mobile Internet device (MID), and a PAD.

As can be seen in the present disclosure, the second monitoring component of the device monitors the second door-opening control signal of the railway vehicle when the railway vehicle is in the automatic door control mode, and the second controlling component automatically controls the door of the railway vehicle at the platform side to be opened when the second door-opening signal of the railway vehicle is obtained through monitoring; since the driver does not need operate manually, the device achieves the technical effect of automatic opening of the door of the vehicle at the platform side, and the lock signal prohibits the door at the non-platform side from being opened when the first door-opening control signal is the incorrect door-opening signal, thus solving the technical problem in the related art.

In the above embodiment of the present disclosure, the device further comprises: a receiving component configured to control the door of the railway vehicle at the platform side to be closed when a first door-closing control signal is received.

It should be noted here that the receiving component may operate in a computer terminal as a part of the device, and functions realized by the component may be implemented through a processor in the computer terminal. The computer terminal also may be a terminal device such as a smart phone (such as an Android phone and an iOS phone), a tablet PC, a palmtop computer, a mobile Internet device (MID), and a PAD.

In the above embodiment of the present disclosure, the device further comprises: a third controlling component configured to control the door of the railway vehicle at the platform side to close when a second door-closing control signal is received, wherein the second door-closing control signal is issued after the preset duration of opening of the door at the platform side.

In the device, the second door-closing control signal is a door-closing signal when the vehicle is in the automatic door control mode, the second door-closing signal is issued automatically by the controller in the driver's cab to control the vehicle to close the door, the opened duration of the door of the vehicle is preset by a person on the controller in the driver's cab according to the flow rate of the visitors to each of the stations, and when the door-opening time of the vehicle reaches the preset duration, the controller will issue a signal of controlling the vehicle to close the doors.

It should be noted here that the third controlling component may operate in a computer terminal as a part of the device, and functions realized by the module may be implemented through a processor in the computer terminal. The computer terminal also may be a terminal device such as a smart phone (such as an Android phone and an iOS phone), a tablet PC, a palmtop computer, a mobile Internet device (MID), and a PAD.

Each of the function units provided in the embodiments of the present disclosure may operate in a mobile terminal, a computer terminal, or a similar computing device, and may also be stored as a part of the storage medium.

The embodiments of the present disclosure may provide a computer terminal, which may be any computer terminal device in a computer terminal group. Optionally in this embodiment, the computer terminal may also be replaced by a terminal device such as a mobile terminal.

Optionally in this embodiment, the computer terminal may be at least one of a plurality of network devices in a computer network.

In this embodiment, the computer terminal may execute the program codes in the following steps of the method for controlling a door of a railway vehicle: receiving a door control instruction sent by the transponder when the railway vehicle draws into the station, wherein the door control instruction is used for determining the doors of the railway vehicle at the platform side; and controlling the railway vehicle to open the door of the railway vehicle at the platform side according to the door control instruction.

Optionally, the computer terminal may comprise one or more processors, a memory, and a transmission device.

The memory may be used to store software programs and components, e.g., program instructions/modules corresponding to the method and device for controlling the door of the railway vehicle in the embodiments of the present disclosure, and the processor implements various function applications and data processing, i.e., implements the method for controlling the door of the railway vehicle by operating the software programs and components stored in the memory. Memory may include high-speed random access memory (RAM), and may also include nonvolatile memory, such as one or more magnetic storage devices, flash memory, or other nonvolatile solid memory. In some examples, memory may further include memories arranged remotely relative to the processor, and these remote memories may be connected to terminals through a network. Examples of the network include, but are not limited to, Internet, Intranet, LAN, mobile communication network, and combinations thereof.

The transmission device is for receiving or transmitting data via a network. Specific examples of the network may include wired network or wireless network. In one example, a transmission device comprises a network adapter (network interface controller, NIC), which may connect a router via a cable or other network devices, thereby communicating with the Internet or LAN. In one example, the transmission device is a radio frequency (RF) module, which is for communicating with the Internet wirelessly.

In an example embodiment, memory is for storing preset action conditions as well as information and applications of preset privileged users.

A processor may call information and programs stored in a memory through the transmission device to execute the program codes in the method steps of optional and preferred embodiments in the above method embodiments.

Those persons with common skill in the art can understand that the computer terminal also may be a terminal device such as a smart phone (such as an Android phone and an iOS phone), a tablet PC, a palmtop computer, a mobile Internet device (MID), and a PAD.

Those persons with common skill in the art may understand that all or partial steps in the various methods of the above embodiments may be completed by hardware relating to terminal device under the instruction of a program. The program may be stored in a computer-readable storage medium, and the storage medium may include flash disk, read-only memory (ROM), RAM, disk or CD.

The embodiments in the present disclosure further provide a storage medium. Optionally in this embodiment, the storage medium may be used to store the program codes executed by the method for controlling a door of a railway vehicle provided in the above method embodiments and device embodiments.

Optionally, in this embodiment, the storage medium may be located in any computer terminal in the computer terminal group of the computer network, or in any mobile terminal in a mobile terminal group.

Optionally, in this embodiment, the storage medium is set to store program codes for executing the steps below: receiving a door control instruction sent by a transponder when a railway vehicle draws into the station, wherein the door control instruction is used for determining a door of the railway vehicle at a platform side; and controlling the railway vehicle to open the door of the railway vehicle at the platform side according to the door control instruction.

Optionally, in this embodiment, the storage medium also may be set to store program codes of various preferred or optional steps provided in the railway vehicle-based door control method.

The method and device for controlling a door of a railway vehicle according to the present disclosure are described above exemplarily with reference to the drawings. However, those skilled in the art should understand that various improvements could be made for the method for controlling a door of a railway vehicle and device proposed in the present disclosure within the spirit and principle of the present disclosure. Therefore, the scope of protection of the present disclosure should be determined by the contents of the appended claimed.

The sequence number of the above embodiments of the present disclosure is only for the purpose of description, and does not indicate the superiority and inferiority of the embodiments.

The above embodiment of the present disclosure each is described emphasizing an aspect, and the portions not described in detail in one embodiment may be seen in other embodiments.

It should be understood that the technical contents disclosed in the several embodiments of the present application may be implemented in other manners. The device embodiments described above are merely schematic; for example, the division of the unit may be logic function-based division, while in actual implementation, there may be other division manners, for example, multiple units or components may be combined or integrated into another system, or some features may be ignored or not implemented. There is another point: the mutual coupling, direct coupling or communicative connection as displayed or discussed may be indirect coupling or communicative connection via some interfaces, units or modules, and may be electrical or in other forms.

The unit described as a separation component may be or may not be separated physically, and the component displayed as a unit may be or may not be a physical unit, i.e., it may be located at a place or distributed over a plurality of units. Partial or all units can be selected according to the requirement to achieve the objective of the solution of the present embodiment.

In addition, the functional units in the embodiments of the present disclosure may be integrated into a processing unit, or each of the units exists alone physically, or two or more units are integrated into a unit. The above integrated units can be implemented in the form of hardware or in the form of a software function unit.

If the integrated units are implemented in the form of a software function unit and sold or used as separate products, they may be stored in a computer-readable storage medium. Based on such understanding, the technical solution of the present disclosure in essence, or the portion that makes contribution for the related art thereof, or all or a part of the technical solution can be embodied in the form of a software product, wherein the computer software product is stored in a storage medium, including several instructions used to cause a computer device (which may be a personal computer, server, network device, etc.) to execute all or partial steps of the method in the embodiments of the present disclosure. The above storage media includes all kinds of media that can store program codes, including U disk, read-only memory (ROM), random-access memory (RAM), mobile hard disk, magnetic disc, and CD.

The above are only the preferred embodiments of the present disclosure and not intended to limit the present disclosure. For those skilled in the art, various modifications and changes can be made to the present disclosure. Any modification, equivalent substitution and improvement made within the spirit and principle of the present disclosure are intended to be included within the scope of protection of the present disclosure.

What is claimed is:

1. A method for controlling a door of a railway vehicle, comprising:

receiving a door control instruction sent by a transponder when the railway vehicle draws into a station, wherein the door control instruction is used for determining a door of the railway vehicle at a platform side;

controlling the railway vehicle to open the door of the railway vehicle at the platform side according to the door control instruction;

wherein before controlling the railway vehicle to open the door of the railway vehicle at the platform side according to the door control instruction, the method further comprises:

selecting a door control mode of the railway vehicle, wherein the door control mode includes a manual door control mode and an automatic door control mode;

wherein when the railway vehicle is in the manual door control mode, controlling the railway vehicle to open the door of the railway vehicle at the platform side according to the door control instruction comprises:

displaying preset display content corresponding to the door control instruction on a preset display device, wherein the display device is a display device located in a driver's cab, and sending a lock signal to a door controller corresponding to a door of the railway vehicle at a non-platform side according to the door control instruction;

monitoring a first door-opening control signal of the railway vehicle, wherein the first door-opening control signal comprises: a correct first door-opening signal controlling the door of the railway vehicle at the platform side to be opened, or an incorrect first door-opening signal controlling the door of the railway vehicle at the non-platform side to be opened;

when the first door-opening control signal is the correct first door-opening signal, controlling the door of the railway vehicle at the platform side to open;

when the first door-opening control signal is the incorrect first door-opening signal, prohibiting the door at the non-platform side from being opened according to the lock signal.

2. The method according to claim 1, wherein when the railway vehicle is in the automatic door control mode, the method comprises:

monitoring a second door-opening control signal of the railway vehicle;

automatically controlling the door of the railway vehicle at the platform side to be opened when a monitored result is that the second door-opening control signal of the railway vehicle is obtained.

3. The method according to claim 1, wherein after controlling the door of the railway vehicle at the platform side to be opened, the method further comprises:

controlling the door of the railway vehicle at the platform side to close when a first door-closing control signal is received.

4. The method according to claim 2, wherein after automatically controlling the door of the railway vehicle at the platform side to be opened, the method further comprises:

controlling the door of the railway vehicle at the platform side to close when a second door-closing control signal is received, wherein the second door-closing control signal is issued after a present duration of opening the door at the platform side.

5. The method according to claim 1, wherein when the railway vehicle draws into the station, the railway vehicle shields a door control instruction by receiving a door control instruction shielding signal, such that a door of the railway vehicle at any side is able to opened according to any door-opening control signal of the railway vehicle.

6. A device for controlling a door of a railway vehicle, comprising:

at least one processor; and a computer readable storage, coupled to the at least one processor and storing at least one computer executable instruction thereon, which when the at least one computer executable instruction is executed by the at least one processor, cause the at least one processor to carry out a method of:

receiving a door control instruction sent by a transponder when the railway vehicle draws into a station, wherein the door control instruction is used for determining a door of the railway vehicle at a platform side;

controlling the railway vehicle to open the door of the railway vehicle at the platform side according to the door control instruction;

wherein before controlling the railway vehicle to open the door of the railway vehicle at the platform side according to the door control instruction, the method further comprises:

selecting a door control mode of the railway vehicle, wherein the door control mode includes a manual door control mode and an automatic door control mode;

wherein when the railway vehicle is in the manual door control mode, controlling the railway vehicle to open the door of the railway vehicle at the platform side according to the door control instruction comprises:

displaying preset display content corresponding to the door control instruction on a preset display device, wherein the display device is a display device located in a driver's cab, and sending a lock signal to a door controller corresponding to a door of the railway vehicle at a non-platform side according to the door control instruction;

monitoring a first door-opening control signal of the railway vehicle, wherein the first door-opening control signal comprises: a correct first door-opening signal controlling the door of the railway vehicle at the platform side to be opened, or an incorrect first door-opening signal controlling the door of the railway vehicle at the non-platform side to be opened;

when the first door-opening control signal is the correct first door-opening signal, controlling the door of the railway vehicle at the platform side to open;

when the first door-opening control signal is the incorrect first door-opening signal, prohibiting the door at the non-platform side from being opened according to the lock signal.

7. The device according to claim 6, further cause the at least one processor to carry out following actions:

when the railway vehicle is in the automatic door control mode, monitoring a second door-opening control signal of the railway vehicle;

automatically controlling the door of the railway vehicle at the platform side to be opened when a monitored result is that the second door-opening control signal of the railway vehicle is obtained.

8. The device according to claim 7, further cause the at least one processor to carry out following actions:

after controlling the door of the railway vehicle at the platform side to be opened, controlling the door of the railway vehicle at the platform side to close when a first door-closing control signal is received.

9. The device according to claim 7, further cause the at least one processor to carry out following actions:

after automatically controlling the door of the railway vehicle at the platform side to be opened, controlling the door of the railway vehicle at the platform side to close when a second door-closing control signal is received, wherein the second door-closing control signal is issued after a present duration of opening the door at the platform side.

10. The device according to claim 8, wherein when the railway vehicle draws into the station, the railway vehicle shields a door control instruction by receiving a door control instruction shielding signal, such that a door of the railway vehicle at any side is able to opened according to any door-opening control signal of the railway vehicle.

* * * * *